US005908235A

United States Patent [19]

Petrozello et al.

[11] Patent Number: 5,908,235

[45] Date of Patent: Jun. 1, 1999

[54] BALLAST FIXTURE FOR FLUORESCENT LIGHTING

[75] Inventors: James R. Petrozello, Endicott; Fletcher W. Chapin, Vestal; David W. Dranchak, Endwell; Robert M. Murcko, Binghamton; Scott W. Knauss, Endicott; Robert H. Katyl, Vestal; John R. Susko, Owego, all of N.Y.

[73] Assignee: JRS Technology Inc., Endicott, N.Y.

[21] Appl. No.: 08/846,195

[22] Filed: Apr. 28, 1997

[51] Int. Cl.[6] ..... F21V 21/00

[52] U.S. Cl. ..... 362/260; 362/219; 362/225

[58] Field of Search ..... 362/260, 219, 362/221, 218, 225, 362; 439/56, 57, 58, 76.1, 226, 235; 361/674, 683, 686, 687, 690, 692, 696, 697, 699, 700, 704, 709, 711, 712, 713, 714, 715, 716, 717, 718

[56] References Cited

U.S. PATENT DOCUMENTS

| | | | |
|---|---|---|---|
| Re. 30,367 | 8/1980 | Belokin, Jr. | 439/235 |
| 3,495,131 | 2/1970 | Melcher | 361/709 |
| 3,572,428 | 3/1971 | Monaco | 361/704 |
| 3,974,418 | 8/1976 | Fridrich | 362/218 |
| 4,344,106 | 8/1982 | West et al. | 361/704 |
| 4,504,891 | 3/1985 | Mazis | 362/219 |
| 4,669,028 | 5/1987 | Faa, Jr. | 361/709 |
| 4,719,540 | 1/1988 | San George et al. | 361/674 |
| 4,729,740 | 3/1988 | Crowe et al. | 439/76.1 |
| 4,874,989 | 10/1989 | Nilssen | 361/674 |
| 5,013,253 | 5/1991 | Aiello et al. | 439/235 |
| 5,170,323 | 12/1992 | Perretta et al. | 361/704 |
| 5,611,393 | 3/1997 | Vasconcelos et al. | 361/704 |
| 5,720,546 | 2/1998 | Correll, Jr. et al. | 362/260 |
| 5,751,117 | 5/1998 | Abbott | 362/260 |
| 5,777,844 | 7/1998 | Kiefer | 361/704 |

*Primary Examiner*—Laura Tso
*Attorney, Agent, or Firm*—Salzman & Levy

[57] ABSTRACT

The present invention features an integrated, electronic fluorescent ballast fixture which includes an electronic ballast packaged with a set of fluorescent lamp connectors into an integral fixture. The fixture has a circuit board that selectably supports up to four fluorescent lamps. The housing of the fixture id configured to receive a number of lamp connectors. The connectors are electrically, connected to the circuit board use wire and poke-in type connectors. When used with conventional, straight fluorescent lamps, a second set of sockets at the far end of the lamps are also connected to the circuit board using wires received in poke-in connector on the circuit board. The integrated ballast package also works with U-shaped lamps. The housing of the fixture is shaped to accommodate projecting electronic ballast components attached to the circuit board. The transformers and transistors of the circuit board may be thermally sinked, so that their heat is carried to the housing by thermally conductive means. The housing consists of two halves that are assembled together with snap-in action latches, making the fixture quickly and easily fabricated. The ballast fixture can be used with a wide variety of light fixtures because of its modularity, affording a high degree of universality.

21 Claims, 8 Drawing Sheets

BALLAST FIXTURE FOR FLUORESCENT LIGHTING

FIELD OF THE INVENTION

The present invention relates to fluorescent light fixtures and, more particularly, to a fluorescent lighting ballast that is integrated with one or more fluorescent lamp connectors into a single, readily configurable package that provides a significant cost reduction to luminaire manufacturers and reduced installation time for installers.

BACKGROUND OF THE INVENTION

The process of manufacturing luminaires for fluorescent lighting has been improved and refined to such a high degree that there are almost no opportunities left for further cost reductions.

The present invention features a means for combining an electronic ballast with one or more fluorescent lamp connectors to form a single, easy-to-assemble, relatively light weight integrated fixture. By transferring a relatively small amount of materials cost from a luminaire to the fixture, the luminaire manufacturer minimizes the additional wiring needed to wire a luminaire, eliminates the need for certain parts in the luminaire, and eliminates several manufacturing processes. Thus, the integrated electronic ballast fixture offers a significant overall cost reduction to the luminaire manufacturer. The reduced installation time also benefits those who replace or upgrade ballasts at locations remote from the luminaire manufacturer.

The integrated electronic ballast fixture is designed for high-speed, low-cost manufacturability. This is accomplished by minimizing the amount of manual labor needed. To reduce the design cycle time and minimize capital expense, the fixture was designed to be able to use off-the-shelf lamp connectors. Electrical connections to the fixture (AC power input, connections to the other end of lamps, lamps, dimmers, etc.) may be implemented as wires and/or one or more connectors, such as of the poke-in or wire-trap varieties. Even though the fixture is typically longer than a standard ballast, it is relatively light-weight since no potting compound is used.

A basic tenet of luminaire manufacturers has been to not allow changes (and in particular increases) to certain luminaire dimensions, such as the overall length, width, and thickness, in order to maintain backward (compatibility with existing luminaires. Because of this design constraint, it is extremely difficult to offer a single integrated ballast fixture that can accommodate all combinations of up to four linear or U-shaped lamps to meet all applications. However, a given integrated fixture design with specific lamp spacings can easily accommodate different quantities and types of lamps. Thus, the integrated fixture of this invention provides a certain degree of universality.

The integrated electronic ballast fixture of this invention is believed to be a major breakthrough for the lighting industry, not only as a cost reduction, but also for its increased reliability. The ballast operates at a lower temperature compared to a standard form-factor enclosure, because the power being lost (in the form of heat) in ballast components such as transformers, resistors, and semiconductors is dissipated over a greater area in a larger volume. Also, since more space is available, components operating at higher temperatures can be spaced further apart to reduce additional heatup. If one or more components, such as a transformer, runs at a temperature higher than desired, further thermal enhancement may be included to increase the operating life. Since heat is dealt with by other means, the fact that this fixture uses no potting compound greatly enhances reliability. Differences of the thermal coefficient of expansion between conventional potting compounds and various electronic components in prior ballasts may cause premature cracking of solder joints, thereby rendering those ballasts inoperative.

The electronic ballast circuitry of the present invention may include components for additional features such as step-dimming, automatic lamp current correction, lumen maintenance, automatic ambient light sensing, and remote ballast control. Sensors for functions such as automatic ambient light sensing may be attached directly to the fixture or may be mounted remotely. Also, the inclusion of more than one ballast, as well as the use of other ballast technologies (e.g., magnetic ballasts), instead of electronic ballasts in the fixture, is well within the scope of this invention.

DISCUSSION OF RELATED ART

In U.S. Pat. No. 5,519,289, issued to Corbett et al, on Jan. 12, 1993, for SECURING COMPONENT ARRANGEMENT, a housing for securing a power transistor is disclosed. The housing acts as a heat sink for the printed circuit of the power transistors, which are inserted into the board from above. Wiring connectors and other components are also located and disposed about the circuit board in preformed holes.

SUMMARY OF THE INVENTION

In accordance with the present invention, there is provided an integrated electronic fluorescent ballast fixture including an electronic ballast that has been combined with a set of fluorescent lamp connectors into an integral fixture. The fixture has at least one circuit board that is operative with, typically, up to four fluorescent lamps. The housing of the fixture has a mechanism defining a number of lamp connector location slots. Except in the case of U-shaped lamps, at least one lamp connector is disposed in a location slot about the housing, and is electrically connected to the circuit board by a wired, poke-in connection. The housing of the fixture is shaped to accommodate projecting electronic ballast components attached to the circuit board. The transformers and transistors of the circuit board may be thermally sinked, so that their heat is carried to the housing by thermally conductive means. The housing consists of two halves that are assembled together with snap-in action latches, making the fixture quickly and easily fabricated. The ballast fixture can be accommodated to a wide variety of light fixtures via its modularity, affording a high degree of universality.

It is an object of this invention to provide an integrated electronic ballast fixture that is modularly compatible, and is electrically operative, with a wide variety of light fixture arrangements.

It is another object of the invention to provide an integrated electronic ballast that is operative with a variable number of fluorescent lamps and lamp fixture designs.

It is another object of the invention to provide an integrated electronic ballast that may incorporate additional features such as step-dimming, automatic lamp current correction, lumen maintenance, and automatic ambient light sensing.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components of this invention will bear the same designation or number throughout the figures.

DESCRIPTION OF THE PREFERRED EMBODIMENT

Generally speaking, the invention features an electronic ballast that has been integrated into a single package with one or more lamp connectors to form a new fluorescent light fixture. The electronic ballast circuitry may include additional components for advanced features such as step-dimming, automatic lamp current correction, lumen maintenance, automatic ambient light sensing, and remote ballast control. The ballast and connectors are combined in a simple, relatively lightweight package that minimizes the additional wiring needed to wire a luminaire, eliminates the need for certain parts in the luminaire, and eliminates several manufacturing processes. Thus, the integrated electronic ballast fixture provides a significant cost reduction to luminaire manufacturers and reduced installation time for installers.

Figure 1:
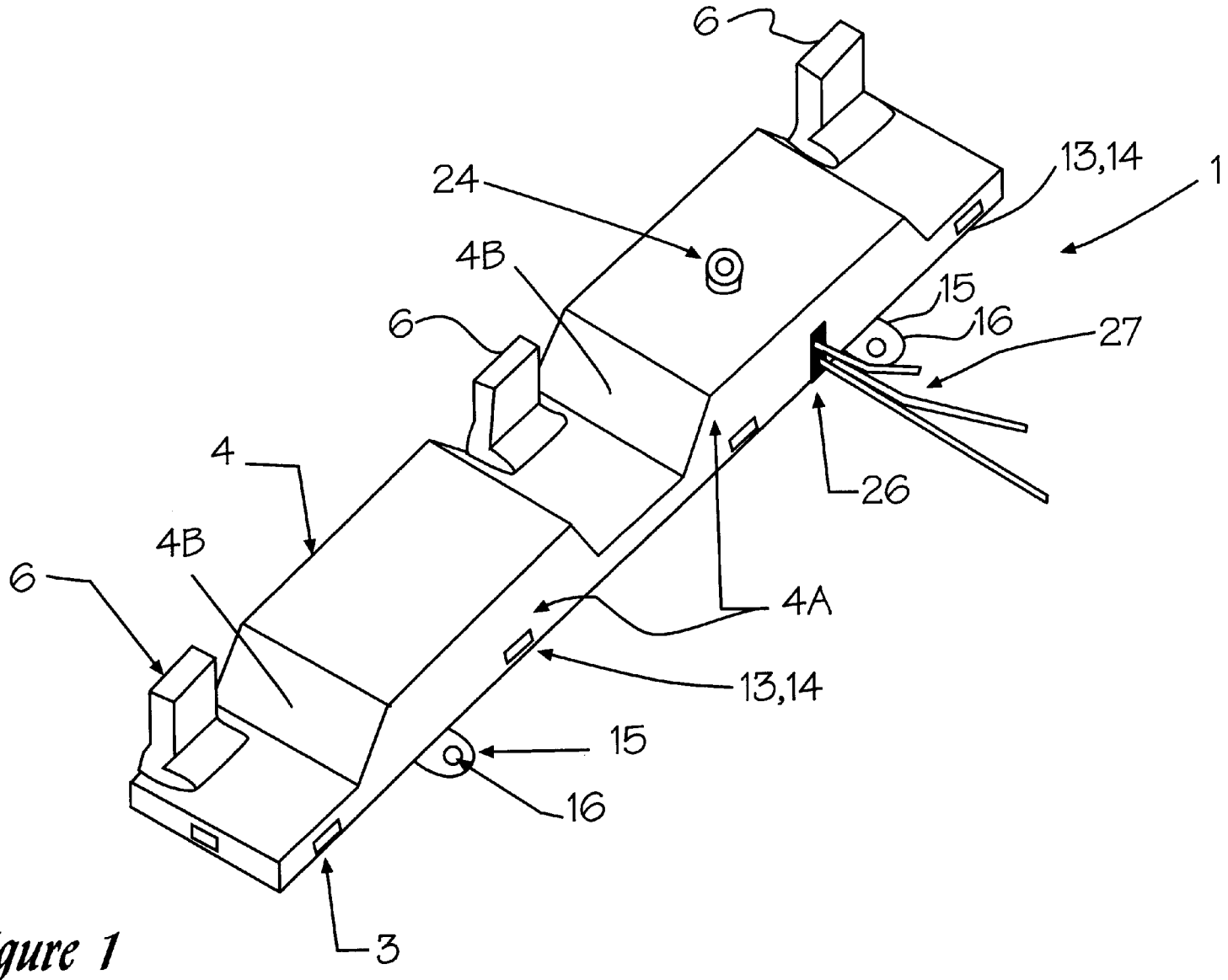
FIG. 1 illustrates a perspective view of the integrated electronic ballast fixture of this invention.
Figure 2:
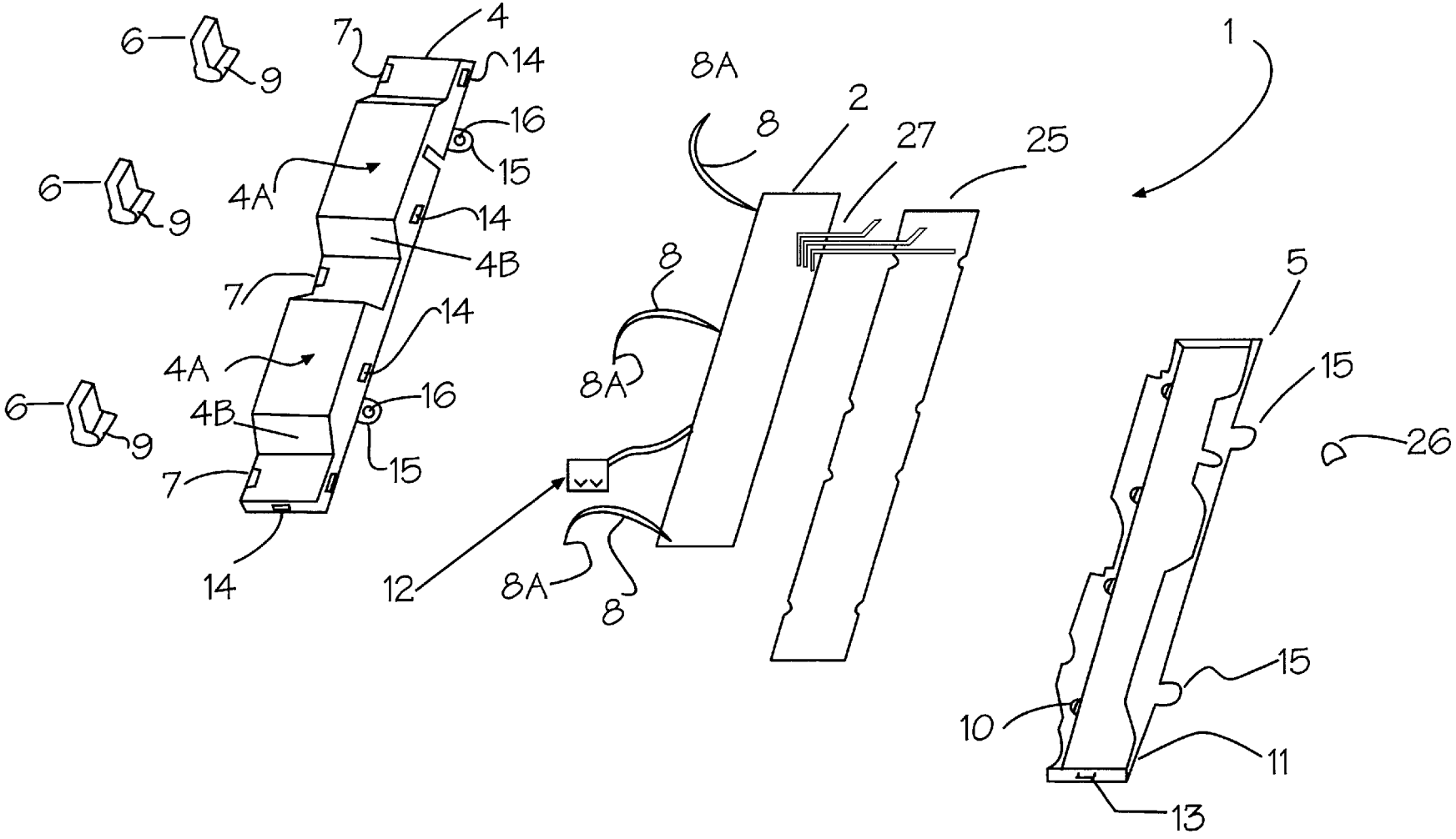
FIG. 2 depicts a perspective, exploded view of the integrated electronic ballast fixture shown in FIG. 1.

Now referring to FIGS. 1 and 2, the integrated electronic ballast fixture 1 of this invention is illustrated in a perspective assembled view and a perspective exploded view, respectively. The electronic ballast fixture 1 consists of a circuit board 2 with, circuitry and components for providing power for up to four fluorescent lamps.

A metal or plastic case 3 houses the internal components. The case or housing 3 consists of an upper, housing cover 4 and a lower, mating base 5. The circuit board 2 is disposed inside the housing 3. A plurality of lamp connectors 6 is positioned upon the upper housing cover 4 of the electronic ballast fixture 1, in various spacings and configurations. The configurational design defines the quantity of lamps that can be accommodated by the fixture. By varying the number of lamp connector location slots 7 disposed in the upper housing cover 4 (FIG. 2), and their location, a great number of different lighting fixture manufacturers' luminaires can be accommodated. The location slots 7 are shown in more detail, and are further explained hereinbelow, with reference to FIG. 3.

This adaptability to different manufactured luminaires and luminaire standards is made possible by the fact that the lamp connectors attach to the circuit board 2 by flexible wire means 8 instead of being soldered directly on the circuit board. This allows the fixture to be operable with one, two, three or four lamps at various spacings befitting the number of lamps. This is extremely important, because it reduces the board part numbers required to support a large number of products. This reduces the cost of manufacture. By positioning standard lamp connectors 6 to the upper housing cover 4 instead of soldering them permanently to the circuit board 2, a great deal of flexibility and modularity is achieved by the inventive fixture. Reliability is greatly enhanced, since the forces exerted by the insertion or removal of lamps are isolated from the solder joints on the circuit board 2.

The standard lamp connectors 6 are each connected to the circuit board 2 by an insulated wire 8. The wires 8 are soldered or mechanically connected to the circuit board 2. During assembly of the fixture 1, a stripped portion 8*a* of the insulated wires 8 is inserted into a poke-in connector 9 at the base of each respective lamp connector 6.

Figure 4:
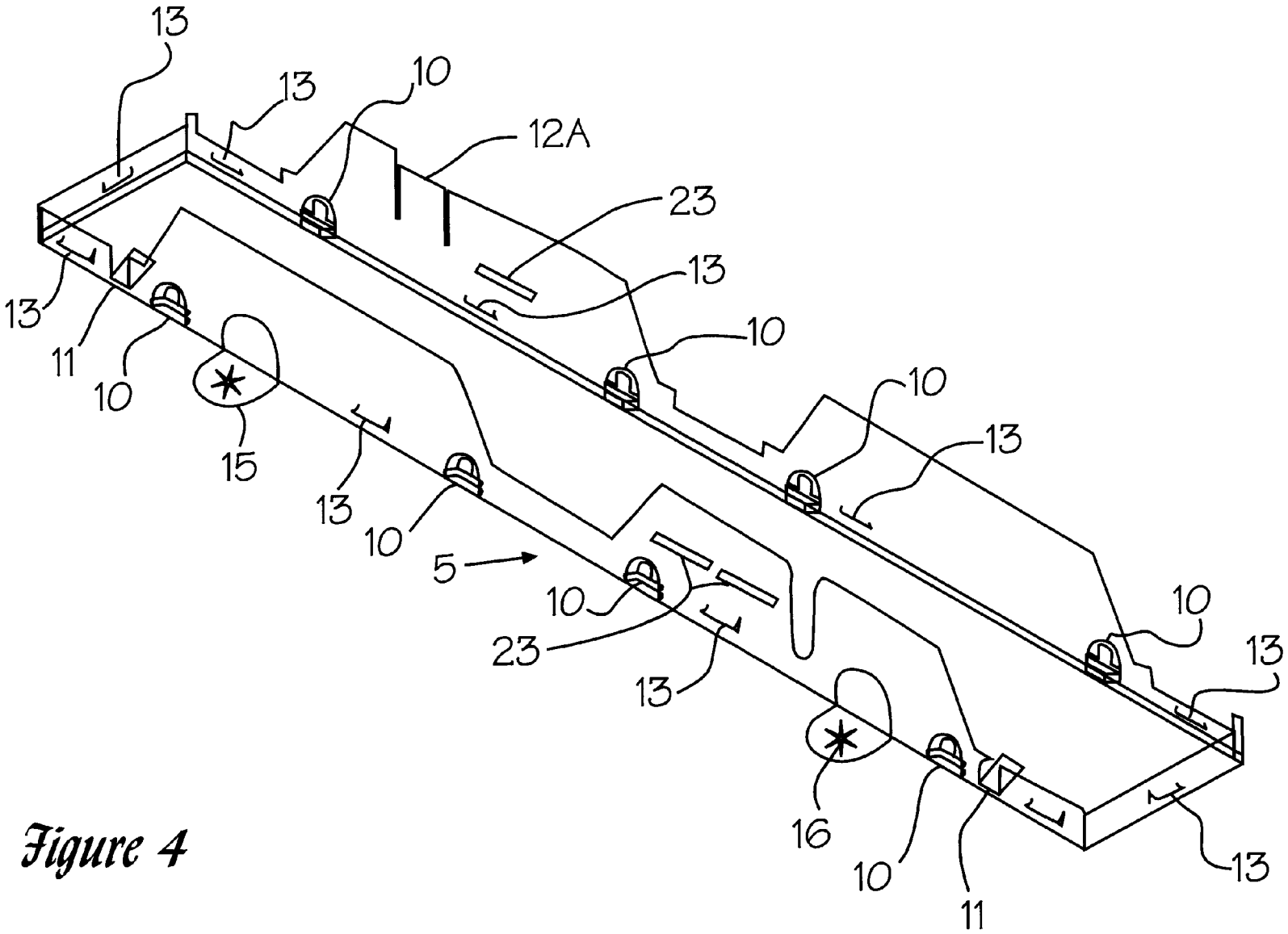
FIG. 4 illustrates a perspective view of the lower, mating portion of the housing of the integrated electronic ballast fixture depicted in FIG. 1.

Referring to FIG. 4, the base portion 5 of the housing 3 is shown as having a plurality of integral board stand-offs and retention tabs 10. These integral stand-offs and tabs 10 are positioned on both sides of the base portion 5. The stand-off portion of the integral stand-off and tab 10 acts as a spacer for keeping the circuit board 2 a predetermined distance from the bottom of the base 5. It also holds the circuit board 2 firmly in place. Two board location tabs 11, are respectively punched out of the base 5 at the ends thereof, and are used to position the circuit board 2 laterally within the housing 3.

Figure 3:
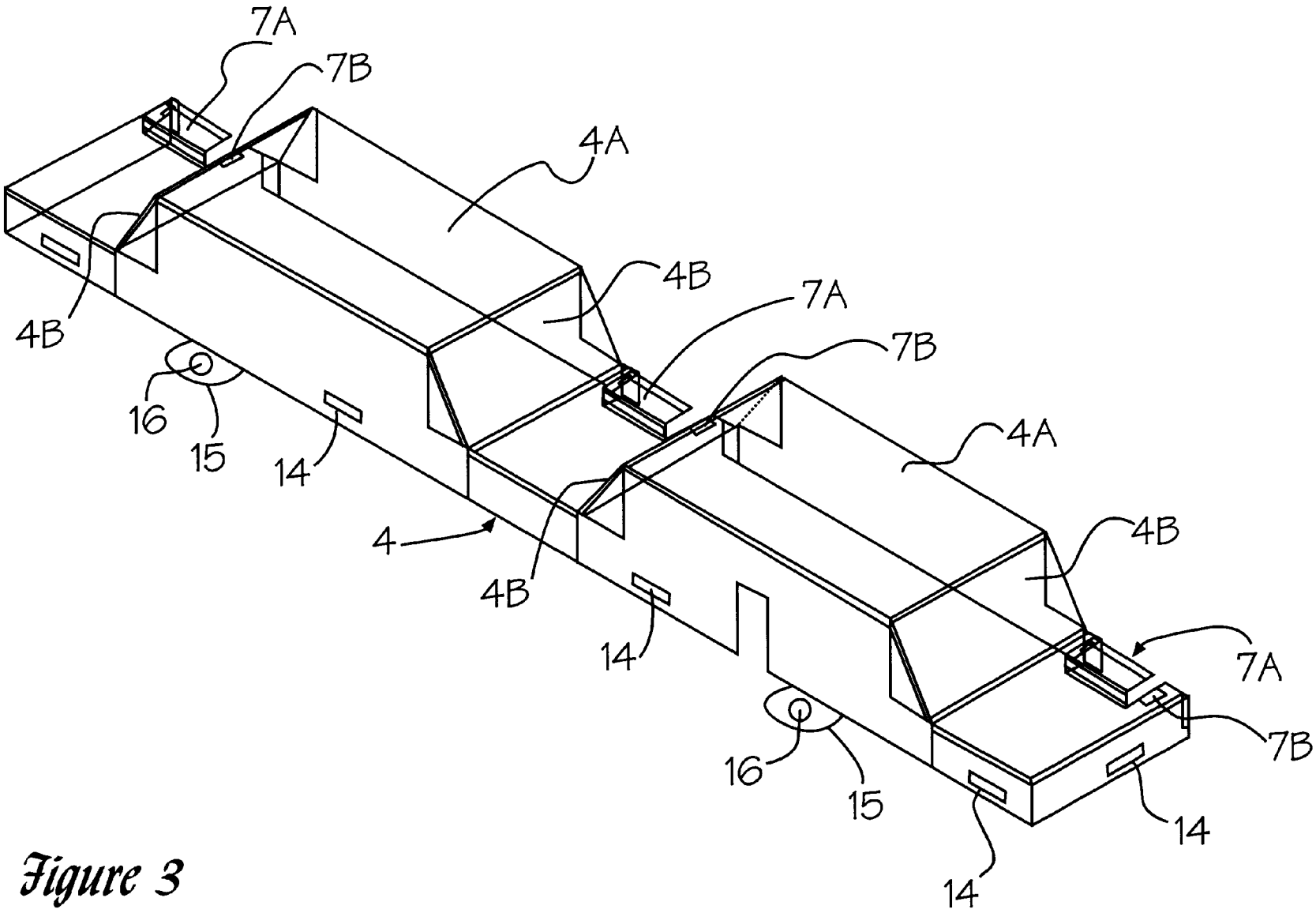
FIG. 3 shows a perspective view of the upper portion of the housing of the integrated electronic ballast fixture depicted in FIG. 1.

Referring to FIG. 3, the components of the circuit board 2 are designed and positioned or located upon the circuit board 2 so as to allow the taller components to nest under the trapezoidal sections 4*a* of the upper housing cover 4. A grounding clip 12 (FIG. 2), connected to a wire soldered into the circuit board 2, attaches to a tab 12*a* located in the side of the base portion 5 to provide a safe ground connection. The upper housing cover 4 of the housing 3 shows the location slots 7 of FIG. 1 in more detail. The location slots 7 have two adjacent slot portions 7*a* and 7*b*. Each has a retention feature, which locates and holds each of the respective lamp connectors 6 firmly in place. The number of slots 7 and their location can be modified in the cover to accommodate various lamp quantities and spacings without affecting the circuit board 2.

The angular walls 4*b* of the trapezoidal section 4*a* have an approximate 30° angle with the base, and are incorporated in the upper housing cover 4 to provide effective reflective surfaces for light reflectance and distribution. Further enhancement of light reflectivity may be achieved by crowning sections 4*a*. These angled surfaces 4*b* also allow for easy insertion and removal of the fluorescent lamps, which may require manipulation into the lighting fixtures in a manner inconsistent with a straight plug-in action. The fact that a typical lamp is approximately forty eight inches long requires that the lighting fixture be almost the same length. Therefore, the lamps are plugged in at an angle, which results in the aforementioned manipulation.

Retention latches 13 are punched out of, and are positioned around, the periphery of the base portion 5 of housing 3, as best observed with reference to FIGS. 2 and 3. These latches 13 mate with, and are captured by, the slots 14 disposed about the periphery of the upper housing cover 4 (best observed with reference to FIGS. 2 and 5). Slots 14 mate with the latch locations 13, as observed. This latching system provides for easy assembly of the fixture 1, and provides a positive retaining force between the two housing cover sections 4 and 5, respectively.

Two spaced-apart tabs 15 are each respectively disposed at mating locations in both the upper and lower, base portions 4 and 5, respectively, of the housing 3. When mated, as when the two housing cover portions 4 and 5 are assembled together, these spaced-apart tabs 15 form two mounting tabs for the fixture 1. These mated, spaced-apart tabs 15 are positioned at the front lower surface of the fixture 1, as shown in FIG. 1. They each contain a self-forming rivet hole 16 for screwing the fixture 1 to a particular luminaire. The tabs 15 are formed from a protrusion from both the cover portion 4 and the base portion 5, so that a secure ground connection is made during the rivet-connecting operation. This provides a safe ground connection for the entire fixture 1.

Figure 6B:
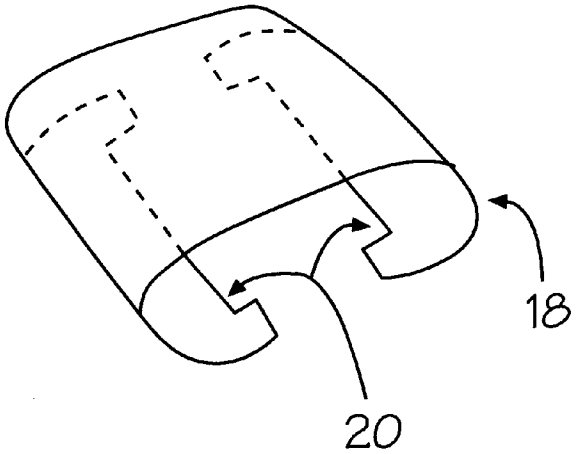
FIG. 6*b* shows a perspective view of the heat sink strip used with the output transformer of the ballast circuit of the integrated electronic ballast fixture depicted in FIG. 1.
Figure 6A:
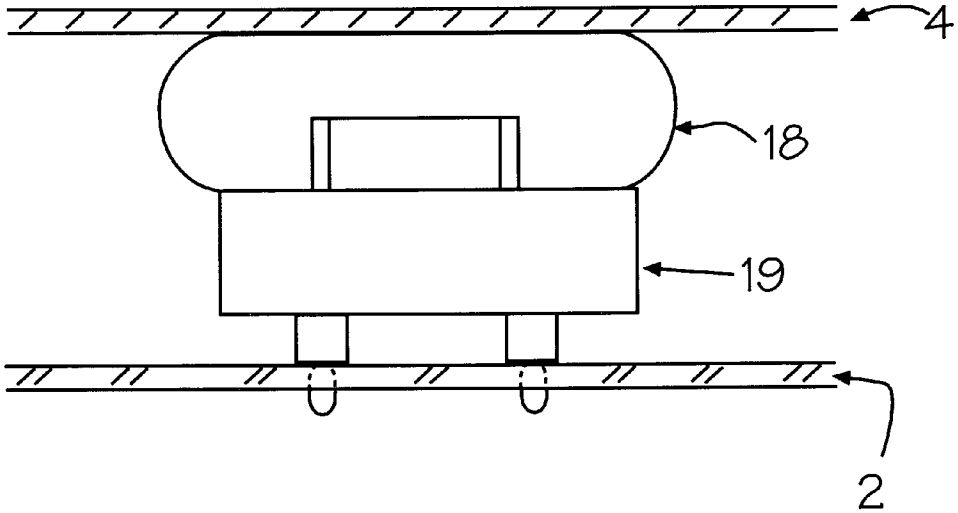
FIG. 6*a* illustrates a side view of the heat sink and transformer assembly of the ballast circuit of the integrated electronic ballast fixture shown in FIG. 1.
Figure 6D:
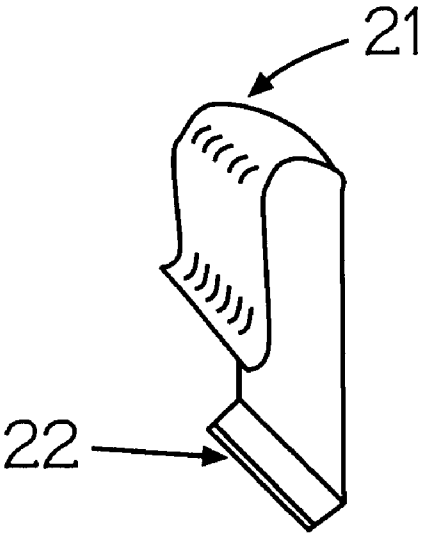
FIG. 6*d* illustrates a perspective view of a thermal heat sink clip used for the transistors of the electronic ballast circuit of the integrated electronic ballast fixture shown in FIG. 2.
Figure 6C:
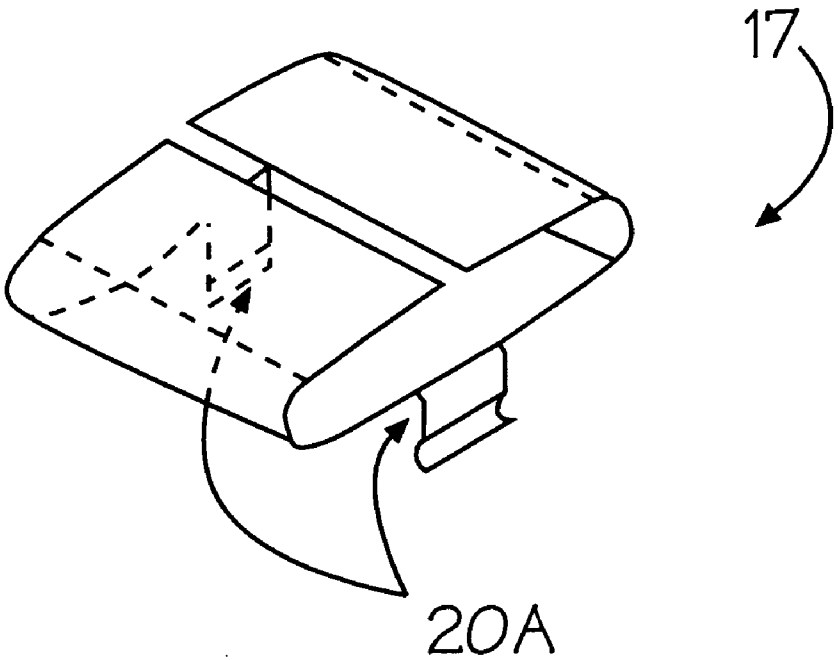
FIG. 6*c* depicts a perspective view of the heat sink strip used with the boost transformer of the ballast circuit of the integrated electronic ballast fixture illustrated in FIG. 1.
Figure 6F:
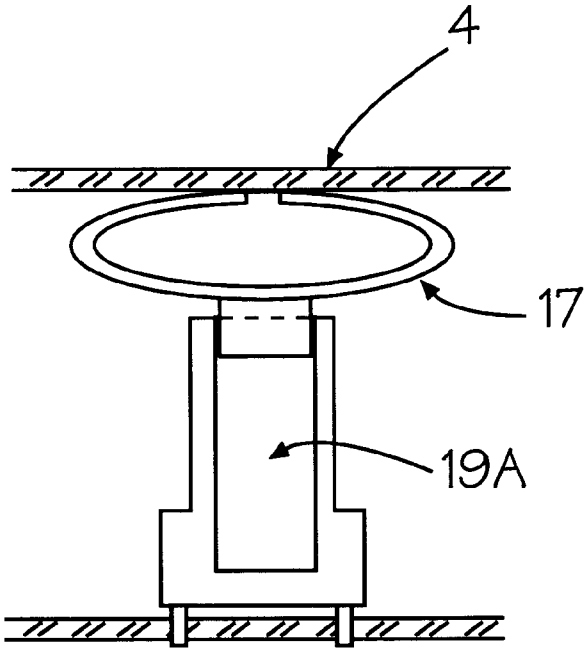
FIG. 6*f* is a cross sectional view of a boost transformer and associated heat sink.

Referring to FIGS. 6*a*, 6*b* and 6*f*, a heat sink 18 is illustrated for the output transformer 19 of the electronic ballast circuit. The heat sink 17 for boost transformer 19*a* (FIG. 6*f*) and heat sink 18 for the output transformer 19 may be respectively added to the assembly, as depicted in FIG. 6*a*. These heat sinks 17 and 18 are made from a thin strip of aluminum, and are fashioned in such a way as to directly contact, and be slightly deformed by, both the ferrite cores of these transformers, 19, 19*a* and the inside surface of the cover 4. It has been found that half-hard aluminum performs well for this use. Heat sink 17 may be formed in a variety of shapes such as "V", "U", "S", or "Z", or a combination thereof. The reliability of the electronic ballast circuitry may be substantially increased by removing heat directly from these two transformers and transferring it directly to the thermally conductive cover 4. The metal strips of the respective heat sinks 17 and 18 are designed to form a compliant spring that provides a constant and direct thermal path from the ferrite cores of the transformers 19, 19*a*, to the metal cover 4. It should be noted that the use of a heat sink to transfer heat away from a transformer to a thermally conductive enclosure may be applied to transformers in other applications where reduced temperature and increased reliability are needed or desired.

A notch 20 (FIG. 6*b*) in heat sink 17 and heat sink tabs 20*a* (FIG. 6*c*) in heat sink 18, positively locates and positions these heat sinks to their respective transformers. The use of aluminum metal, while thermally conductive, causes no electrical or magnetic effect on the transformers that will interfere with their electrical performance.

Figure 5:
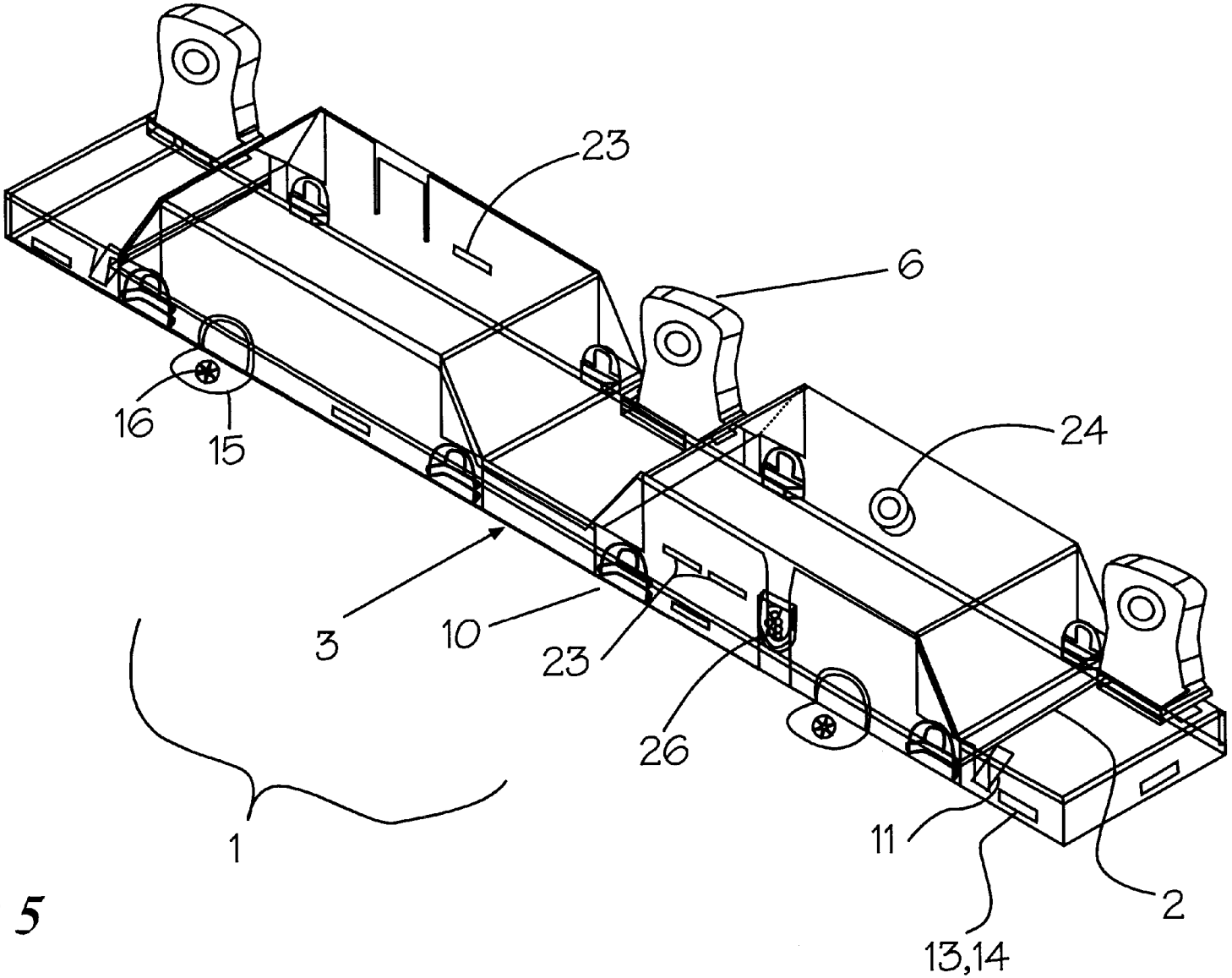
FIG. 5 depicts a perspective view of the two portions of the housing illustrated in FIGS. 3 and 4, when joined together.
Figure 6E:
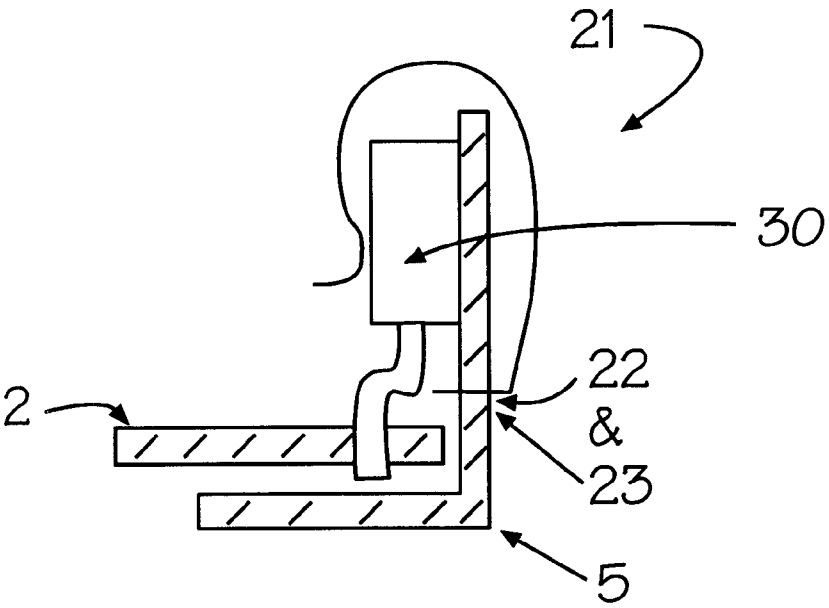
FIG. 6*e* shows a side view of the thermal heat sink clip as applied to the transistors of the circuit board of the integrated electronic ballast fixture illustrated in FIG. 2.

Referring to FIG. 6*d*, a transistor heat sink clip 21 is shown for use with the transistor 30 (FIG. 6*e*) in the circuit board 2 of the fixture 1 (FIG. 2). Three of these transistor heat sink clips 21 hold the three main transistors firmly to the base walls to provide heat sinking for increased reliability. The transistor clips 21 are made from stainless steel and have a positioning tab 22 located at the base of the clip 21. The tab 22 latches into slots 23 disposed about the sides of the base portion 5, as shown in FIGS. 4 and 5. This latching system provides for easy installation and prevents the clips 21 from becoming dislodged.

A photosensor 24 (FIG. 5) may be positioned about the upper housing cover 4 to allow for automatic adjustment of the lighting in the fixture 1 with that of the ambient room light. Thus, the integrated ballast can adjust to the proper amount of light required. For example, such regulation is most useful during bright outside light conditions. The photosensor 24 can dim or deactuate one or more lamps during bright light conditions, thus resulting in substantial energy savings.

A mylar insulator 25 (FIG. 2) is positioned under the circuit board 2 to prevent possible shorting from leads protruding from the back of the board 2 to the base section 5.

A strain relief 26 (FIGS. 2 and 5) is positioned at the front of the ballast. Three wires 27 egress from this strain relief 26. Two of the wires 27 are for input power and the other one is for a common connection to the opposite ends of the fluorescent lamps, to complete the lamp circuit. A board mounted poke-in connector can also be used for this purpose.

Some of the major advantages of the fixture 1 of this invention are the ability of the circuitry to service a number of lamps, and to conform to various lamp spacings. This includes the ability to vary quantity of lamps from one to four. The use of a standard, inexpensive lamp connector 6 provides an easy means by which a lamp connector can be replaced without dismantling the ballast. The fixture is easily assembled and provides a cost-reduced assembling into the overall light fixture for the lighting manufacturers, due to its elimination of wire, hardware and labor. As aforementioned, there is improved thermal performance resulting in higher reliability and longer life of the ballast. In addition, the housing is designed to enhance the reflection of light, thus improving the lighting efficiency of the lighting fixture.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An integrated fluorescent ballast fixture comprising at least one ballast that has been combined with one or more lamp connectors into an integral light fixture, said light fixture comprising:

at least one circuit board containing said ballast, said circuit board being operative with at least one fluorescent lamp;

a housing supporting said circuit board and comprising means defining a number of lamp connector location apertures;

at least one lamp connector disposed in a location aperture in said housing said connector being displaced from said circuit board; and connection means for electrically connecting said at least one lamp connector to said circuit board whereby said ballast fixture can be modified to include additional lamp connectors.

2. The integrated electronic fluorescent ballast fixture in accordance with claim 1, wherein said connection means comprises a poke-in connector for receiving an electrical wire from said circuit board.

3. The integrated electronic fluorescent ballast fixture in accordance with claim 1, wherein said housing of the fixture is shaped to accommodate projecting electronic ballast components attached to the circuit board.

4. The integrated electronic fluorescent ballast fixture in accordance with claim 1, wherein said housing comprises at least one substantially trapezoidally-shaped unit for accommodating projecting electronic ballast components, and for providing light reflectance.

5. The integrated electronic fluorescent ballast fixture in accordance with claim 1, wherein said circuit board comprises transformers and transistors, and further wherein said transformers and transistors are thermally sinked so that heat generated by said transformers and said transistors is carried to said housing.

6. The integrated electronic fluorescent ballast fixture in accordance with claim 5, wherein the thermally sinked transformers and transistors are thermally sinked by thermally conductive means disposed between respective transformers and transistors, and said housing.

7. The integrated electronic fluorescent ballast fixture in accordance with claim 1, wherein the housing comprises two halves that are snap-action assembled to each other.

8. The integrated electronic fluorescent ballast fixture in accordance with claim 7, wherein one of the two halves of the housing comprises male elements, and further wherein the other one of the two halves of the housing comprises female elements for accommodating said male elements, said male and female elements quickly snapping together for easily fabricating said housing.

9. An integrated electronic fluorescent ballast fixture comprising, in combination, a set of fluorescent lamp connectors electrically and mechanically connected to an electronic ballast to form an integral light fixture, said light fixture comprising:

a circuit board containing said electronic fluorescent ballast having transistors and transformers, said circuit board accommodating, and being operative with, one or more fluorescent lamps;

a bifurcated housing supporting said circuit board and comprising location-defining means defining a number of lamp connector location apertures; and at least one lamp connector disposed in a lamp connector location aperture of said housing, and being displaced from, and electrically connected to said circuit board by connection means whereby said ballast fixture can be modified to include additional lamp connectors.

10. The integrated electronic fluorescent ballast fixture in accordance with claim 9, wherein said lamp connector is electrically connected to said circuit board by a poke-in connector disposed therein, said poke-in connector receiving an electrical wire from said circuit board.

11. The integrated electronic fluorescent ballast fixture in accordance with claim 9, wherein said bifurcated housing is shaped to accommodate projecting electronic ballast components attached to the circuit board.

12. The integrated electronic fluorescent ballast fixture in accordance with claim 9, wherein said bifurcated housing comprises at least one substantially trapezoidally-shaped unit for accommodating projecting electronic ballast components, and for providing light reflectance.

13. The integrated electronic fluorescent ballast fixture in accordance with claim 9, wherein said transformers and transistors of said circuit board are thermally sinked, such that heat generated by said transformers and said transistors is carried to said bifurcated housing.

14. The integrated electronic fluorescent ballast fixture in accordance with claim 13, wherein the thermally sinked transformers and transistors are thermally sinked by thermally conductive means disposed between respective transformers and transistors, and said bifurcated housing.

15. The integrated electronic fluorescent ballast fixture in accordance with claim 9, wherein the bifurcated housing comprises two halves that are snap-action assembled to each other.

16. The integrated electronic fluorescent ballast fixture in accordance with claim 15, wherein one of the two halves of the housing comprises male elements, and further wherein the other one of the two halves of the housing comprises female elements for accommodating said male elements, said male and female elements quickly snapping together for easily fabricating said housing.

17. An integrated electronic fluorescent ballast fixture comprising, in combination, a set of fluorescent lamp connectors electrically and mechanically connected to an electronic ballast to form an integral light fixture, said light fixture comprising:

a circuit board containing said electronic fluorescent ballast having transistors and transformers, said circuit board accommodating, and being operative with, one or more fluorescent lamps;

a bifurcated housing supporting said circuit board within two housing sections, and further comprising connection means defining a number of lamp connector location slots disposed about said housing; and at least one lamp connector disposed in a lamp connector location slot of said housing, and being displaced from, and electrically connected to said circuit board by connection means whereby said ballast fixture can be modified to include additional lamp connectors.

18. The integrated electronic fluorescent ballast fixture in accordance with claim 17, wherein said bifurcated housing comprises at least one substantially trapezoidally-shaped unit for accommodating projecting electronic ballast components, and for providing light reflectance.

19. The integrated electronic fluorescent ballast fixture in accordance with claim 17, wherein said transformers and transistors of said circuit board are thermally sinked, such that heat generated by said transformers and said transistors is carried to said bifurcated housing.

20. The integrated electronic fluorescent ballast fixture in accordance with claim 19, wherein the thermally sinked transformers and transistors are thermally sinked by thermally conductive means disposed between respective transformers and transistors, and said bifurcated housing.

21. The integrated fluorescent ballast fixture in accordance with claim 1, wherein said ballast is a electronic ballast.

* * * * *